US006446903B1

(12) United States Patent
Bazan

(10) Patent No.: US 6,446,903 B1
(45) Date of Patent: Sep. 10, 2002

(54) YARD SIGN WITH DISPENSER

(76) Inventor: Nicholas F. Bazan, 2724 Dell Zell Dr., Indianapolis, IN (US) 46220

( * ) Notice: Subject to any disclaimer, the term of this patent is extended or adjusted under 35 U.S.C. 154(b) by 0 days.

(21) Appl. No.: 09/568,837

(22) Filed: May 11, 2000

(51) Int. Cl.[7] ..... B65H 75/18

(52) U.S. Cl. ..... 242/597.8; 242/598.3; 242/599

(58) Field of Search ..... 242/597.8, 597.5, 242/598.3, 598.5, 599, 129.5, 129.6, 129.62; D20/40–42, 10

(56) References Cited

U.S. PATENT DOCUMENTS

| | | | | | |
|---|---|---|---|---|---|
| 306,258 | A | * | 10/1884 | Judd | 242/129.6 |
| 346,154 | A | * | 7/1886 | Hadley | 242/599 |
| 438,457 | A | * | 10/1890 | Wheeler | 242/599 |
| 549,672 | A | * | 11/1895 | Jewell | 242/422.5 |
| 2,771,219 | A | * | 11/1956 | Dewey | 222/93 |
| 2,959,368 | A | * | 11/1960 | Neff | 242/560.3 |
| 4,344,583 | A | * | 8/1982 | Drum | 242/55.2 |
| 4,477,111 | A | | 10/1984 | Crooks | |
| 4,677,697 | A | | 7/1987 | Hayes | |
| 5,167,377 | A | * | 12/1992 | Chalmers | 242/55.2 |
| D361,794 | S | | 8/1995 | Oakley | |
| 5,441,017 | A | | 8/1995 | Lindsay | |
| 5,476,296 | A | | 12/1995 | Gross | |
| D367,078 | S | | 2/1996 | Oakley | |
| 5,551,569 | A | | 9/1996 | Garvin-Mazzarisi | |
| 5,564,762 | A | | 10/1996 | Ring | |
| 5,586,521 | A | | 12/1996 | Kelley | |
| 5,628,537 | A | | 5/1997 | Kiemer | |
| 5,725,268 | A | | 3/1998 | Besasie et al. | |
| 5,741,036 | A | | 4/1998 | Ring | |
| 5,860,529 | A | * | 1/1999 | Smithson et al. | 206/554 |
| 6,152,079 | A | * | 11/2000 | Chandler | 119/161 |
| 6,205,686 | B1 | * | 3/2001 | Davis | 36/138 |

* cited by examiner

*Primary Examiner*—Donald P. Walsh
*Assistant Examiner*—Joseph Rodriguez
(74) *Attorney, Agent, or Firm*—Baker & Daniels

(57) ABSTRACT

A yard sign for dispensing plastic bags for use in collecting domestic pet waste for later disposal includes a display panel attachable to the ground and a supply of waste bags dispensed from the rear of the sign through a slot. The display panel preferably has a contour that depicts a familiar object such as a dog or other animal. A dispensing slot or opening is preferably positioned at the location of the animal's mouth. Waste bags are stored on a continuous perforated roll on the back of the sign. In one embodiment of the invention, bag storage and dispensing is accomplished by the use of a hanger assembly including a mounting bracket and a U-shaped rod with one arm of the rod serving as a holder for a roll of bags. In another embodiment, bags are held and dispensed by a strap retained by snap fasteners on the back of the sign. In use, the sign is placed in a yard in an area convenient to a pet owner walking his or her pet to facilitate the pet owner's ability to dispose of pet waste. The present invention encourages responsibility on the part of pet owners when in public or common areas.

7 Claims, 13 Drawing Sheets

YARD SIGN WITH DISPENSER

FIELD OF THE INVENTION

The invention relates to a decorative yard sign that dispenses bags for disposal of domestic pet waste. More particularly, the invention relates to a dispenser of bags for animal waste that encourages responsibility on the part of pet owners through the use of humor and by facilitating the collection and later disposal of domestic animal waste.

BACKGROUND OF THE INVENTION

With the increasing population density in our urban areas, there tends to be less open space areas for pets, in particular dogs, to roam for both exercise and tending to other natural functions. At the same time, pet ownership has also increased. Pet owners must provide opportunities to their pets for exercise and relieving themselves as a part of daily routine pet care. Moreover, many municipalities have enacted laws governing pet ownership and the use of public spaces. For example, many areas have leash laws requiring dogs to be restrained by leashes whenever they are on public property. Such ordinances serve a two-fold purpose. First, the public at large is in less danger of being harmed by the animals; and second, the owner is better able to control the animal to keep it from mischief.

Another area of increasing concern brought about by space limitations in our urban areas involves the issue of environmental cleanliness. Pet owners are typically expected to clean up after their pets when they are away from their own property. In fact, many municipalities and neighborhoods have enacted ordinances and rules requiring pet owners to remove pet waste in public and common areas. With or without such ordinances, this is an area of concern for responsible pet owners. Accomplishing this task can be a rather tedious and non-hygienic affair. Typically the pet owner is required to carry a receptacle, usually a sealable plastic bag, along with something in the nature of a scoop or tool for picking up the pet waste. Unfortunately, even a responsible pet owner will often forget to bring the pet waste disposal equipment on a walk from time to time. Thus, pet owners are discouraged from complying with their legal and moral obligations to their neighbors.

Various inventions have been made to provide the pet owner with devices for gathering pet waste material. Representative of these are the devices disclosed in U.S. Pat. No. 5,628,537 to Kiemer, U.S. Pat. No. 5,476,296 to Gross and U.S. Pat. No. 4,477,111 to Crooks. Each of these patents discloses a device that provides means for collecting pet droppings. The drawback to this approach to the problem of pet waste cleanup is simply that it requires too much in the way of equipment, which must be carried when walking a pet. In addition, the pet must still be controlled while the pet owner operates the device and/or bends over to accomplish the cleanup operation. Therefore, for many pet owners, the task is ignored because it is just not easy and convenient enough.

Chalmers (U.S. Pat. No. 5,167,377), Ring (U.S. Pat. No. 5,564,762), and Hayes (U.S. Pat. No. 4,677,697) recognized these problems and attempted to address them. Chalmers discloses a portable bag dispensing device containing a roll of bags. The pet owner pulls a bag from the roll, slip his hand inside, pick up the waste material, and then pulls the bag off the hand turning it inside out and leaving the contents inside. Similarly, in Hayes, the pet owner carries a plastic glove dispenser containing disposable gloves used in essentially the same manner as the bags in Chalmers. In Ring, the pet owner carries a receptacle with a plastic liner covering the inside of the receptacle and also extending over the hand of the user. In use, the waste material is scooped into the lined container followed by pulling the liner off the hand and out of the receptacle retaining the waste material inside. These inventions, although simpler and somewhat easier to use than the more cumbersome devices aforementioned, still require the pet owner to carry equipment and bend over while still controlling the pet.

A need has remained for a simple and easy solution that allows the pet owner to leave home unencumbered yet provides the opportunity for the owner to clean up after his pet as the need arises. The ideal solution would also encourage compliance.

SUMMARY OF THE INVENTION

The present invention provides a yard sign that dispenses bags for use in collecting domestic animal or pet waste for later disposal. The waste bags are provided as an inducement for pet owners to clean up after their pets. A supply of bags is maintained on the back of the sign and singularly dispensed through a slot as needed.

The yard sign includes a decorative display panel having the contour of an animal such as a dog or of some familiar object. The sign is firmly attached to the ground, such as by staking. The front of the panel is painted or otherwise decorated to draw attention to the availability of the bags. When an animal is depicted, the dispensing slot is preferably positioned at the location of the animal's mouth so that the leader bag, or first bag on the roll, resembles the animal's tongue.

Waste bags are stored on the back of the sign preferably on a continuous perforated roll. In one embodiment of the invention, bags are stored and dispensed from a hanger assembly including a mounting bracket and a U-shaped rod with one arm of the rod serving as a holder for a roll of bags. In another embodiment, the roll of bags is held on the back of the sign by a strap running through the center of the roll and attached to the back by snap fasteners. In both cases, the end of the roll is fed through the slot in the panel ready to be pulled through and torn off when needed.

In use, the sign is placed in a yard in an area convenient to pet owners walking their pets to facilitate the pet owner's ability to dispose of pet waste. The invention presents an apparatus which encourages responsibility on the part of pet owners when in public or otherwise away from their own homes.

Accordingly, a primary object of the present invention is to provide an improved apparatus in the form of a yard sign which facilitates the pet owner's ability to collect pet waste for later disposal thus encouraging responsibility on the part of pet owners when in public or otherwise away from their own homes. This and other objects, advantages and features are accomplished according to the devices, assemblies and methods of the present invention.

DESCRIPTION OF THE PREFERRED EMBODIMENTS

Figure 1:
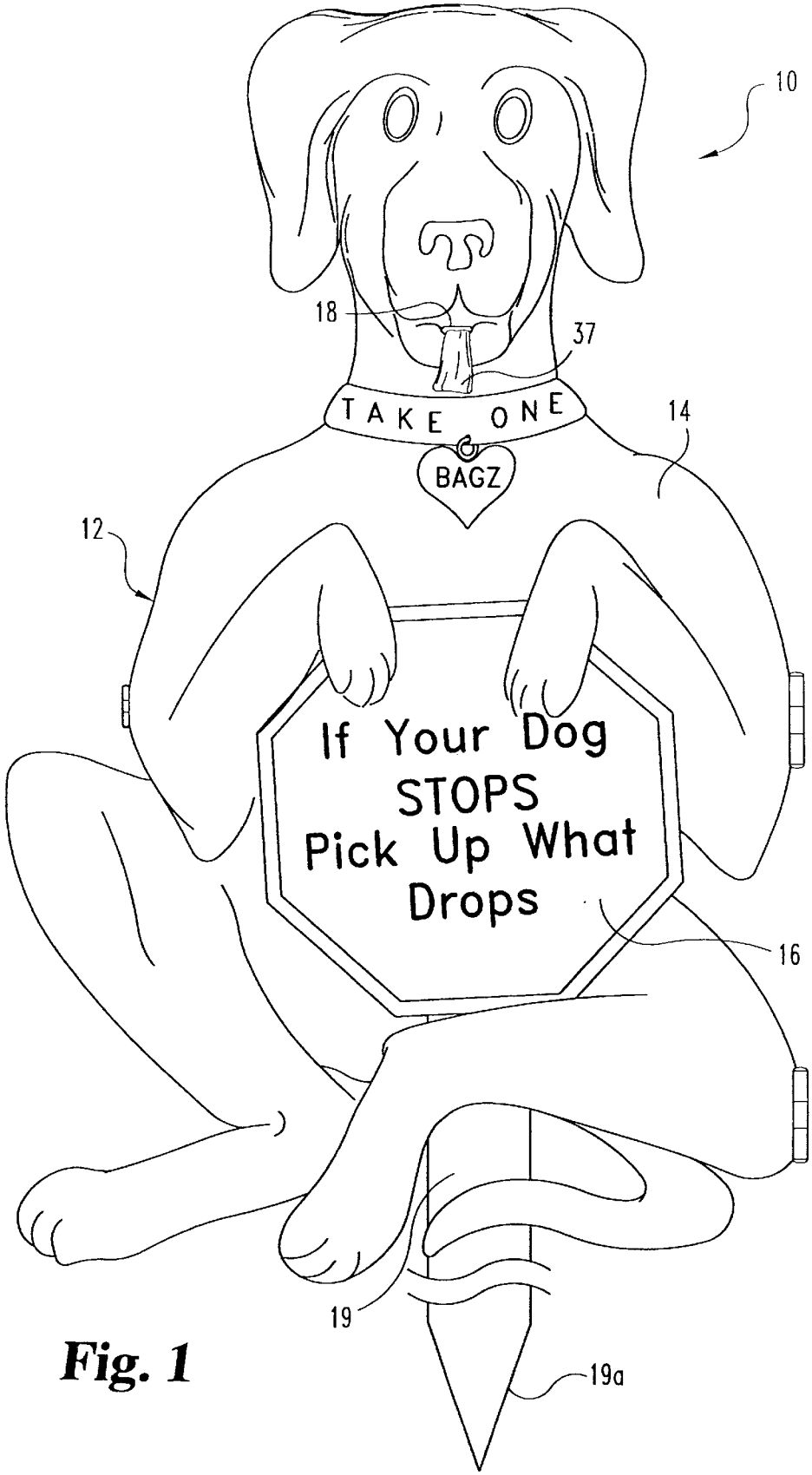
FIG. 1 is a front elevational view of one embodiment of the invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a device that facilitates disposal of pet waste. The invention presents an apparatus that encourages compliance with the legal and moral obligations of pet ownership.

Figure 2:
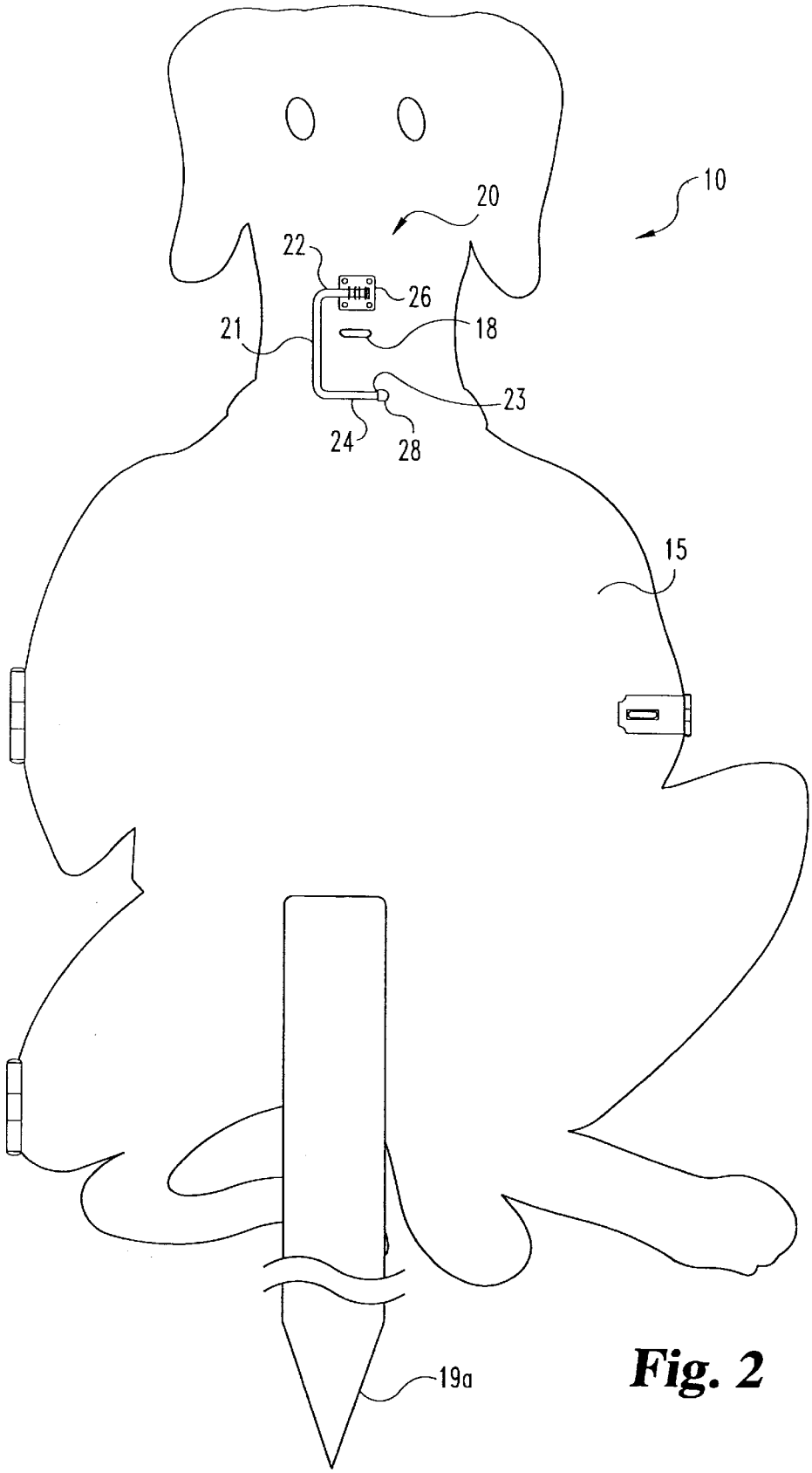
FIG. 2 is a rear elevational view of the display panel of the embodiment of FIG. 1 showing one means of storing and dispensing bags.
Figure 3:
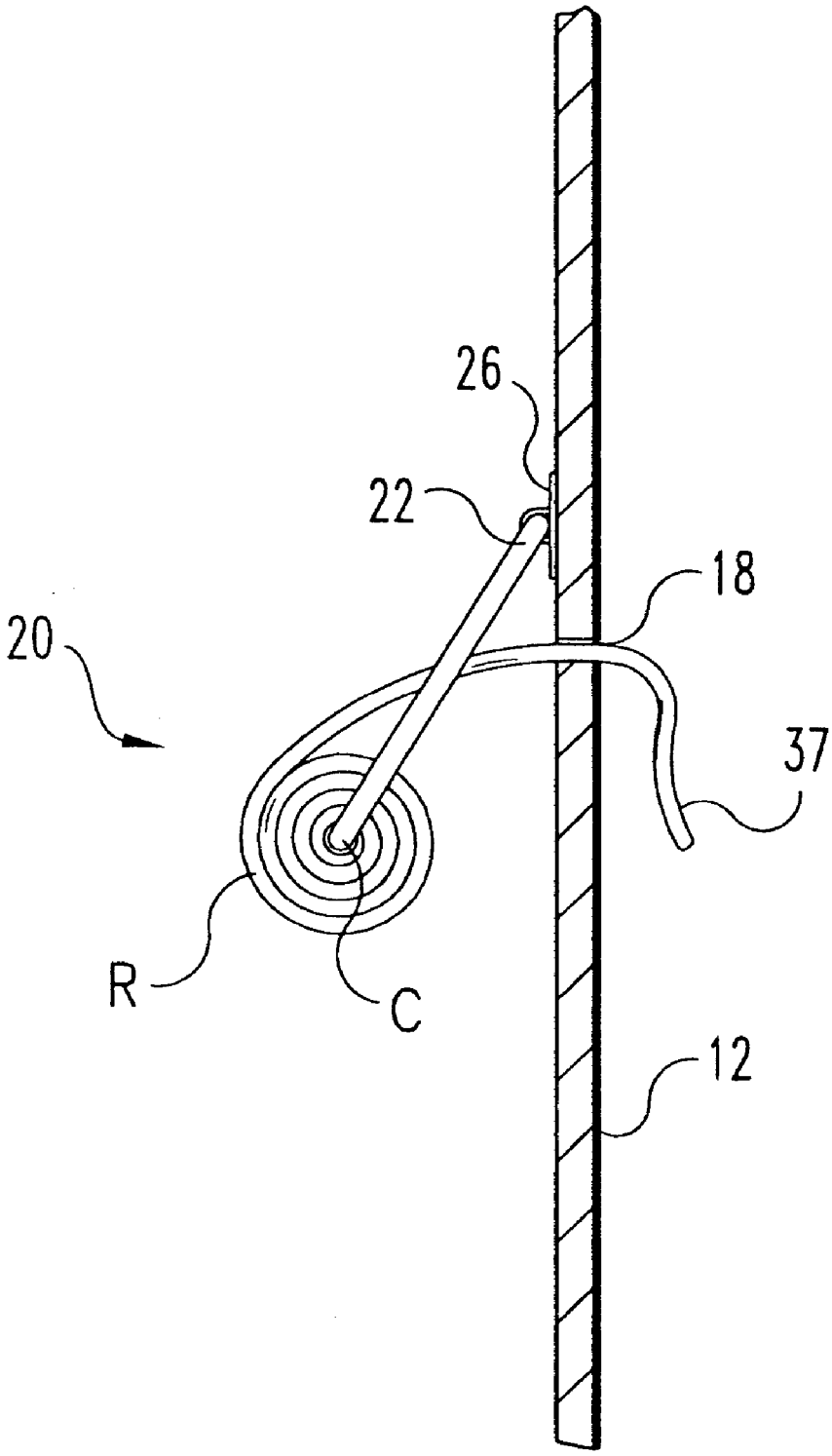
FIG. 3 is a partial side sectional view of the embodiment of FIG. 1.

A device for dispensing waste bags in accordance with a preferred embodiment of the present invention is illustrated in FIGS. 1–3. The device 10 includes a yard sign having a display panel 12 with a decorative front surface 14 resembling a character and a back surface 15. The panel is preferably made from a plastic material and cut in the contour of the character or a familiar object such as a fire hydrant. In the preferred embodiment, shown in FIG. 1, the display panel 12 depicts a dog in combination with a stop sign 16. The front 14 of the panel 12 includes an area for a note, message or instructions. Preferably, the message will be humorous. In this embodiment, the stop sign 16 is the message area. In this embodiment, the sign is secured to the ground by a stake 19. Preferably, stake 19 will have a pointed end 19*a* for facilitating driving the stake into the ground.

The device 10 also includes an opening 18 through which bags are dispensed. Preferably, the dispensing opening 18 should be positioned at a convenient location such as somewhere near the top of the sign. In the embodiment shown in FIG. 1, opening 18 is positioned at the location of the dog's mouth. The bags are threaded through mouth 18 so that the leader bag 37 extends through the opening 18 and hangs slightly to resemble a happy dog's tongue. Preferably, the bags have a color that approximates the color of a dog's tongue, such as pink or red. The leader bag 37 extends out through the opening 18 and can be torn off at the perforation by snapping or urging the leader bag against the edge of the mouth opening 18. Typically, if an animal design is chosen for the sign, the dispensing opening should be placed at the location of the animal's mouth. If an inanimate object is chosen, any convenient area, preferably near the top, could be used.

Bags are preferably dispensed from a perforated roll mounted on the rear side of the sign. FIG. 2 shows the back surface 15 of the sign of FIG. 1 with a bag dispenser. The dispenser 20 includes a hinge 26 attached to the back surface 15 of the panel 12 and a rod 21 having a first end 22 attached to the hinge 26. The rod 21 also includes a free second end 23 and a roll mounting portion 24 disposed between the first and second ends 22, 23. Hinge 26 urges the roll mounting portion 24 towards the back surface 15 of the panel 12 as shown in FIG. 3. In this particular embodiment, the rod 21 is U-shaped and the hinge 26 is a bracket as shown in FIGS. 2 and 3. The mounting bracket 26 can be attached to the rear of the sign by any appropriate means such as by screws. Rod 21 is rotatable within the bracket 26 to allow the roll mounting portion 24 to swing away from the sign to accommodate a roll R. A roll of bags is mounted on the roll mounting portion 24 by placing arm 24 through the center C of the roll R. A retaining cap 28 can be engaged to the second end 23 to keep the roll from sliding off the rod 21. Bags are fed from the roll through the opening 18 to the front surface 14 of the sign. The weight of the bags together with the weight of the rod and the action of the hinge operate to hold the bag roll against the back surface 15 of the sign 10 and thus helps control the unrolling of the roll of bags to singularly dispense each bag from the roll, as more clearly shown in the partial cut away views shown in FIG. 3.

Figure 4:
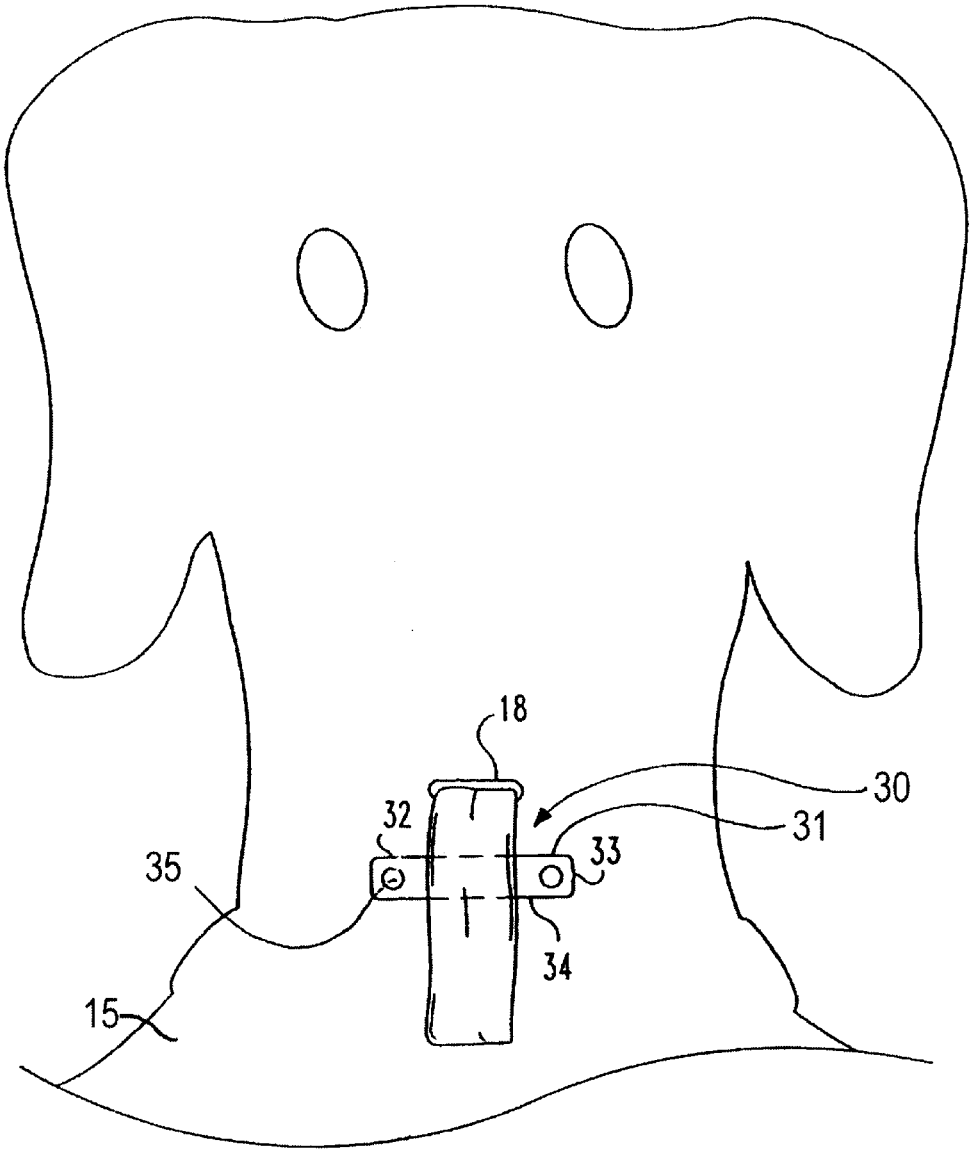
FIG. 4 is a partial elevational view of the rear of the display panel of the embodiment of FIG. 1 showing an alternate means of storing and dispensing bags.
Figure 5:
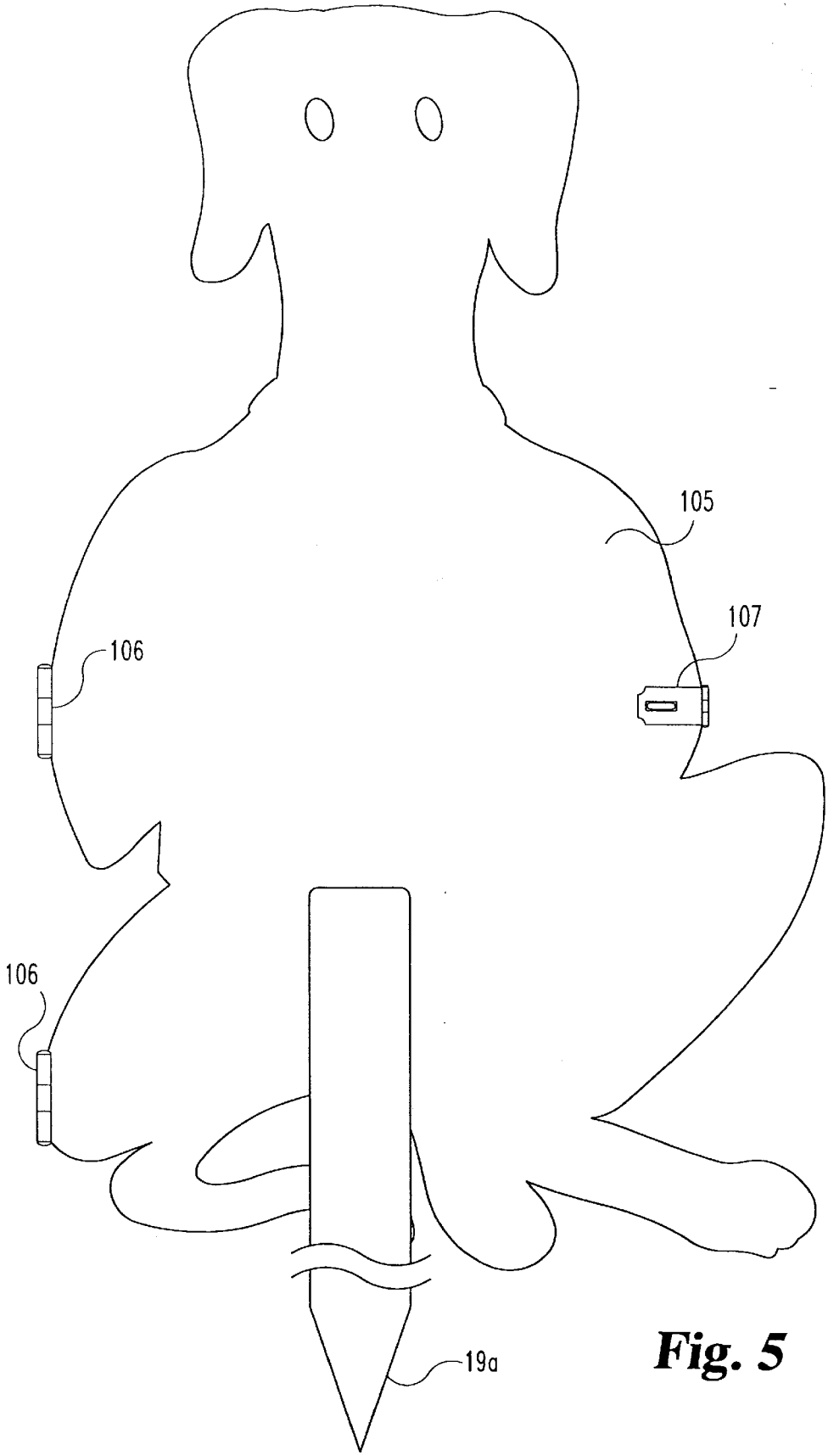
FIG. 5 is an elevational view of a cover member attached to the embodiment of FIG. 1.
Figure 6:
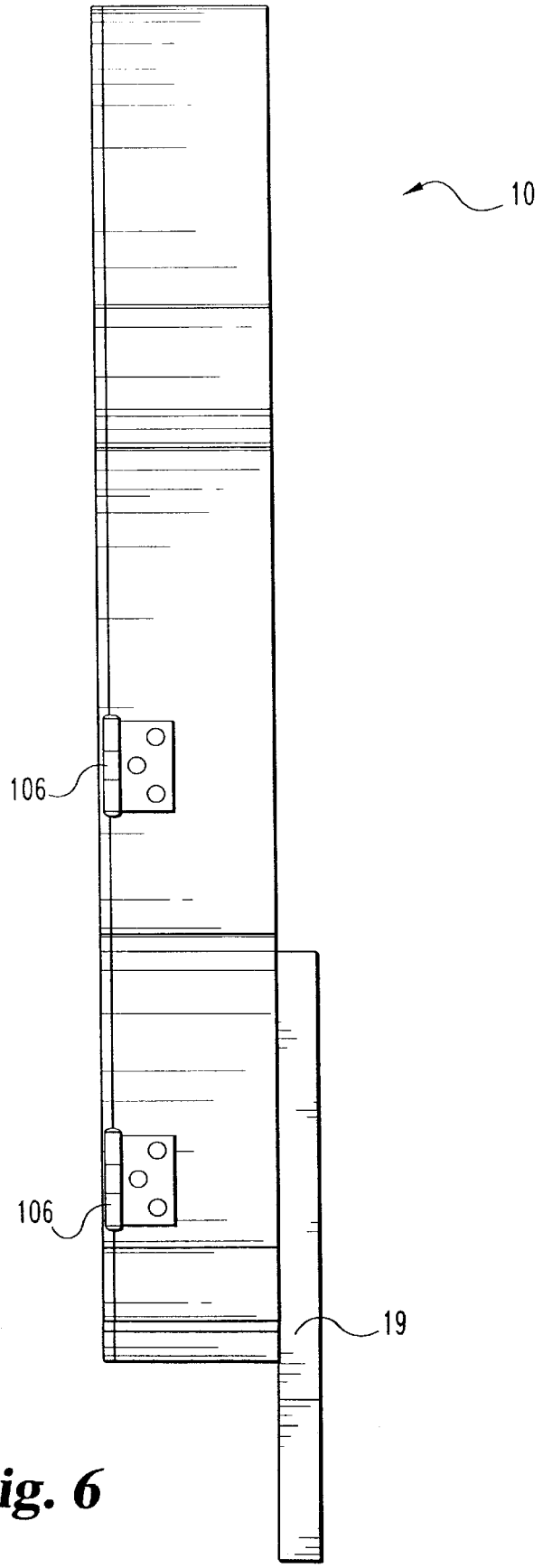
FIG. 6 is a left side elevational view of the embodiment of FIG. 1.
Figure 7:
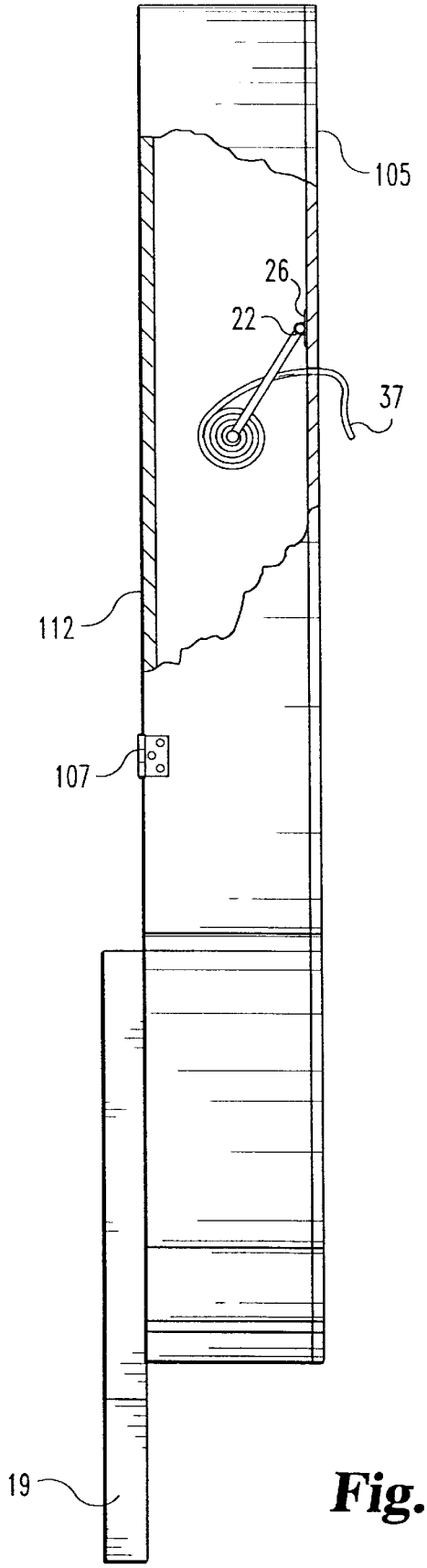
FIG. 7 is a right side elevational, partial cut away, view of the embodiment of FIG. 1.
Figure 8:
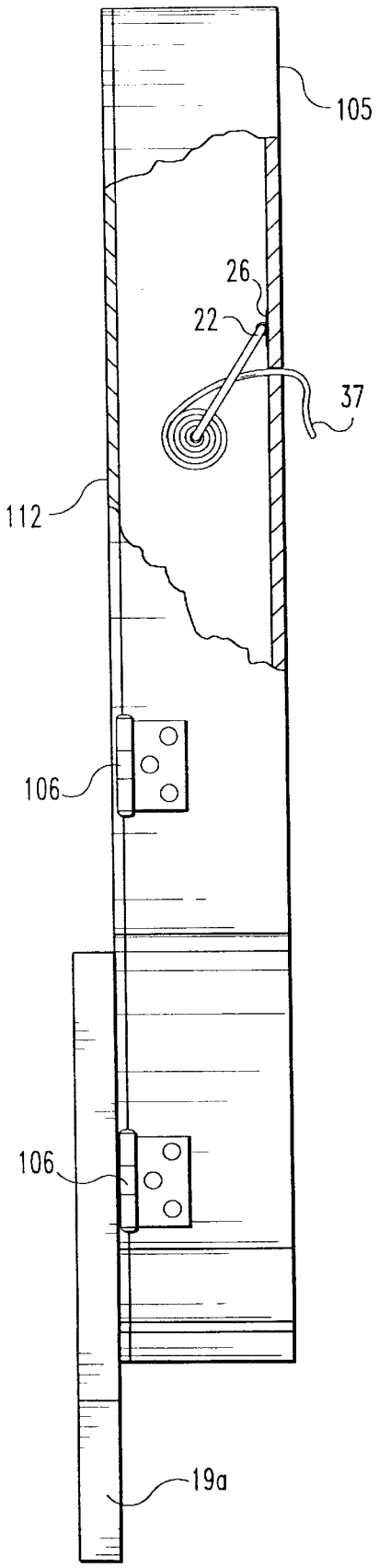
FIG. 8 is a left side elevational, partial cut away, view of the embodiment of FIG. 1.
Figure 9:
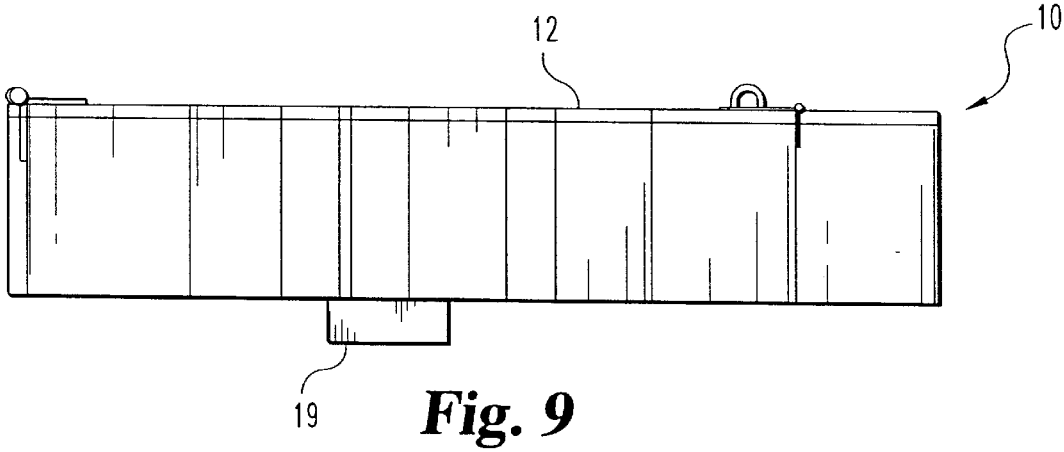
FIG. 9 is a top view of the embodiment of FIG. 7.
Figure 10:
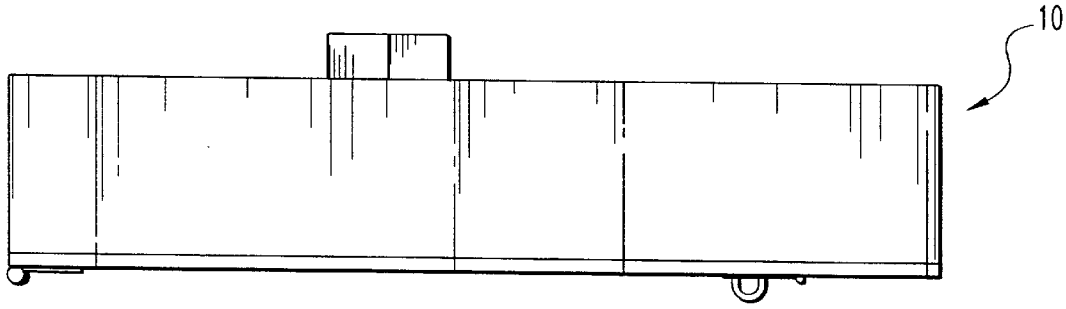
FIG. 10 is a bottom elevational view of the embodiment of FIG. 7.
Figure 11:
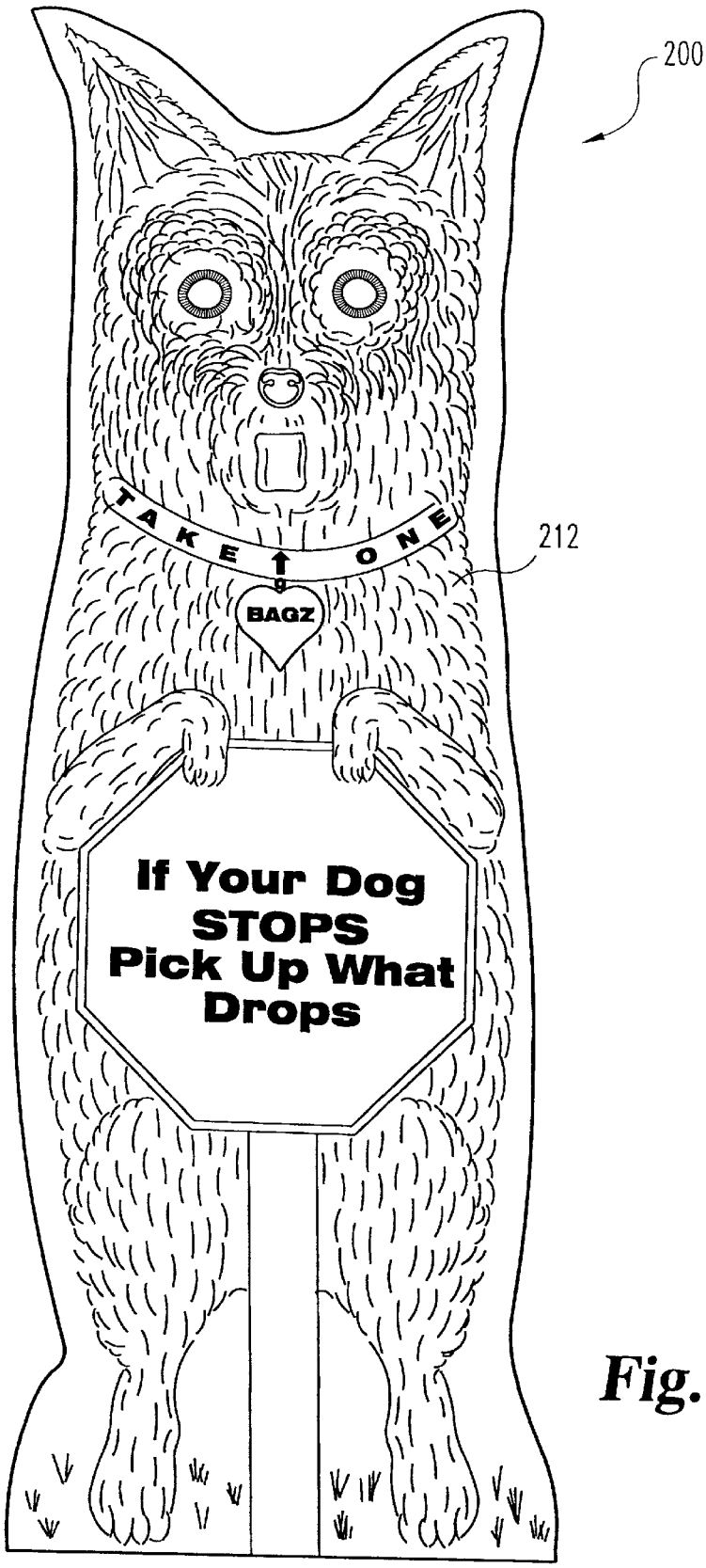
FIG. 11 is a front elevational view of another embodiment of this invention.
Figure 12:
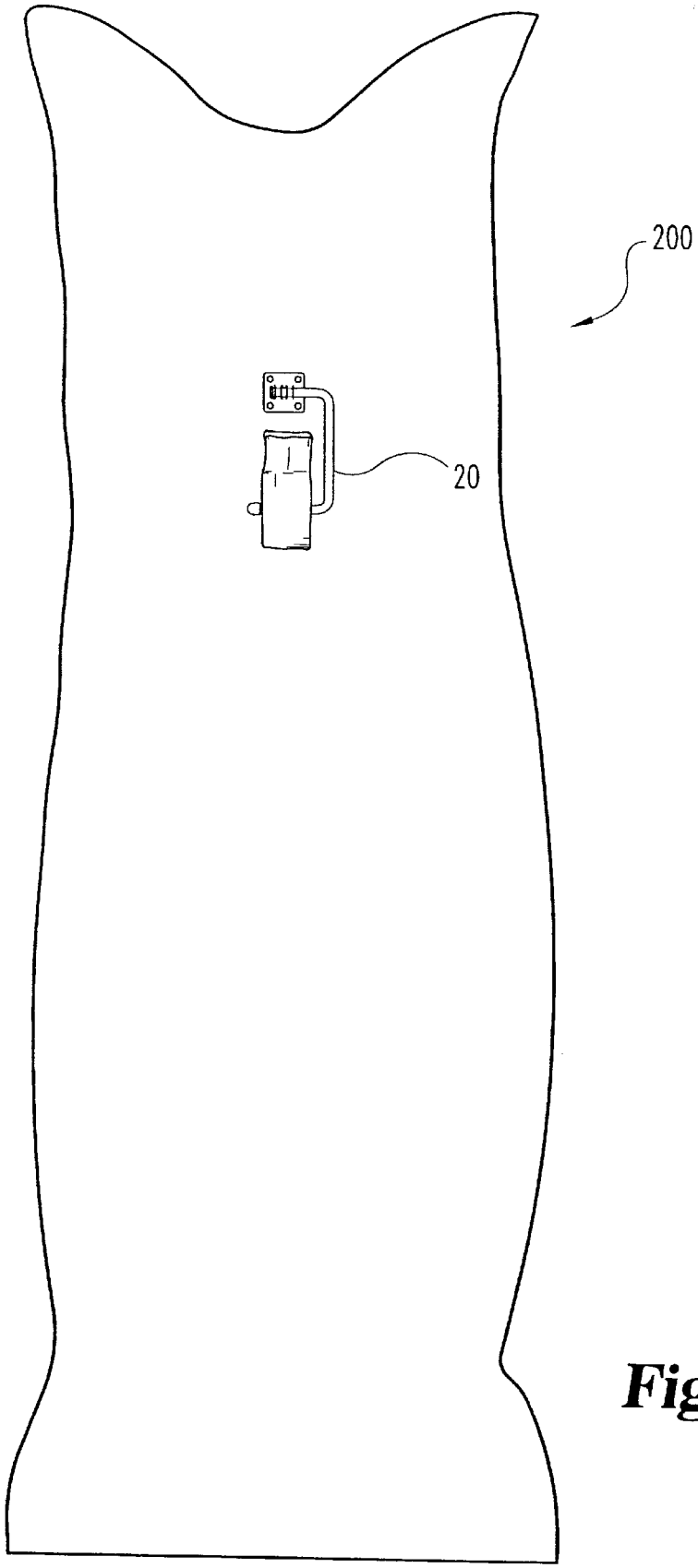
FIG. 12 is a back elevational view of the embodiment of FIG. 11.
Figure 13:
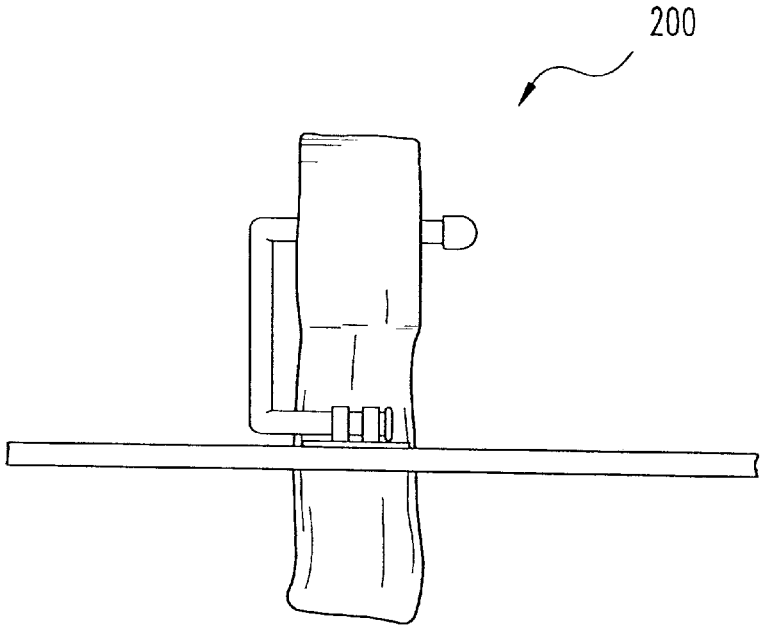
FIG. 13 is a top elevational view of the embodiment of FIG. 11.
Figure 14:
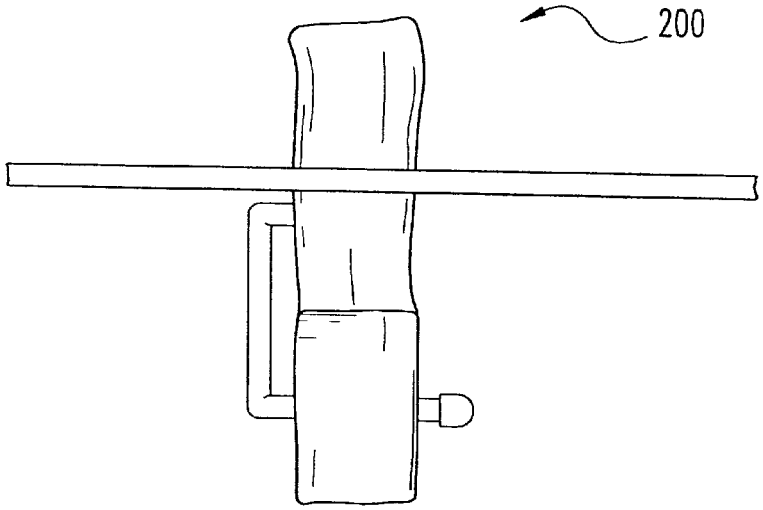
FIG. 14 is a bottom elevational view of the embodiment of FIG. 11.
Figure 15:
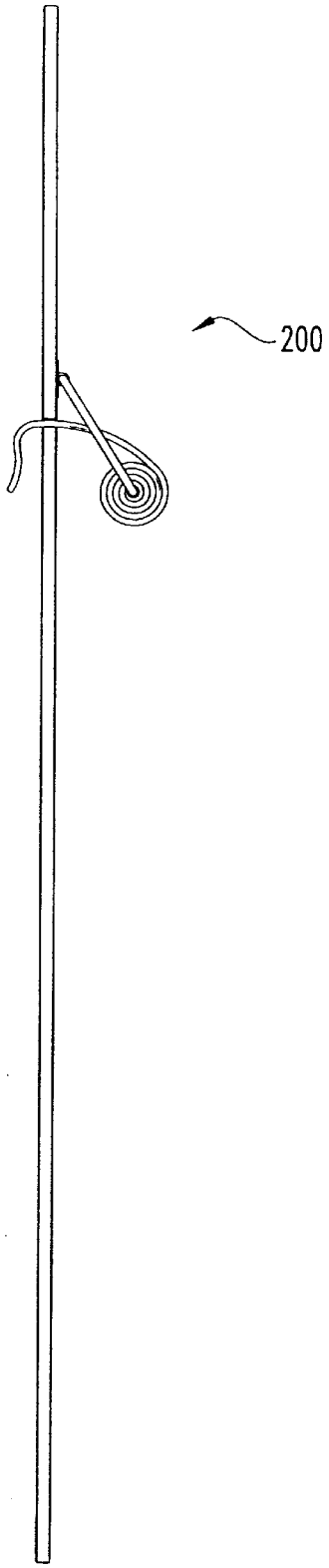
FIG. 15 is a left side elevational view of the embodiment of FIG. 11.
Figure 16:
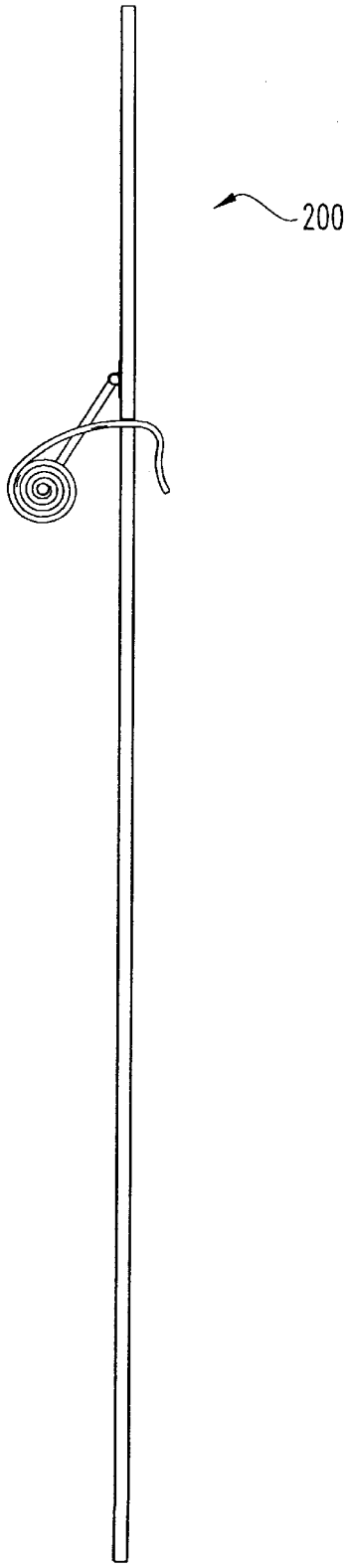
FIG. 16 is a right side elevational view of the embodiment of FIG. 11.

An alternate means of dispensing bags, as shown in FIG. 4, includes an elongated strap 31. The dispenser 30 includes a first end 32, a second end 33, and a roll mounting portion 34 between the ends 32, 33. At least one of the first and second ends 32, 33 are releasably engaged to the back surface 15. In preferred embodiments, the first and second ends 32, 33 are engaged with snap fasteners 35.

In a particular embodiment, shown in FIGS. 5–10, a cover member 105 releasably covers the back of the display panels 12 to protect and hide dispensing mechanism. Cover member 105 preferably has at least one hinge member 106 and a latch member 107 for releasably covering the dispensing mechanism. Preferably the cover member 105 would also be decorative in nature. In this embodiment, the back member resembles the back of the dog character of FIG. 1.

In use, the sign is placed in a yard in an area convenient to pet owners walking their pets. The leader bag should have its end visibly protruding through the dispensing slot 18. The pet owner can pull the bag through the slot 18 and tear it off at the perforation leaving the end of the next bag protruding through the slot 18. The pet owner then places his hand inside the bag, picks up the waste material, then pulls the bag over the hand turning the bag inside out and leaving the waste material inside. The invention thus facilitates the pet owner's ability to dispose of pet waste.

Another embodiment is depicted in FIGS. 12–17. This sign 200 includes the same bag dispenser 20 depicted in FIG. 5 but the display panel 212 is contoured and drawn to resemble another breed of dog. The signs of this invention can be configured to resemble any breed of dog or any other character or animal.

The device is a decorative sign that is appealing to the eye so that placing the device in a yard will not detract from the landscape. The sign could also be constructed to present a likeness of the homeowners own pet. The present invention preferably uses humor to encourage compliance. For example, the sign in preferred embodiments depicts a cute dog with a stop sign saying "If your dog stops, pick up what drops."

The sign can be made from any suitable weatherproof material such as plastic or fiberglass or a laminate having a plastic or weatherproof outer coating. A ceramic material would also be effective. Any of these would yield a light weight, portable, and inexpensive sign. The stake could be of metal, or treated wood with metal being preferred.

While the invention has been described with a certain degree of particularity, it is apparent that variations and modifications can be made with the attainment of all the advantages of the invention without departing from the spirit and scope of the invention disclosed. It is understood that the invention is not limited to the embodiments set fourth herein for purposes of exemplification, but is to be limited only by the scope of the attached claims, including the full range of equivalency to which each element thereof is entitled.

What is claimed is:

1. A yard sign for dispensing animal waste bags, comprising:

a panel having the shape of a character and defining an opening therethrough, said opening configured to resemble said character's mouth, said panel having a decorative front surface resembling the character and a back surface;

a bag dispenser attached to said back surface of said panel, said dispenser positioned to dispense bags through said opening and comprising a hinge attached to the back surface of said panel, a rod having a first end attached to said hinge, a free second end, and a roll mounting portion disposed between said first and second ends, said hinge urging said roll mounting portion towards said back surface of said display panel; and a post attached to said panel for engaging said panel to the ground.

2. A yard sign for dispensing bags, including:

a panel having a first surface and a second surface, the second surface having a character depicted thereon;

an opening in the panel;

a bag dispenser attached to the first surface, the dispenser including a rod having a first end connected to the panel by a hinge such that the rod can rotate, the rod including a roll mounting portion; and a post attached to the panel for securing the panel to the ground.

3. The yard sign of claim 2, wherein the rod has a second end and the roll mounting portion is located between the first and second ends.

4. The yard sign of claim 2, further including a roll of bags and wherein a portion of one bag extends through the opening and represents the animal's tongue.

5. The yard sign of claim 2, further including a roll of bags and wherein a portion of one bag extends through the opening.

6. A yard sign for dispensing bags, including:

a panel having a first surface and a second surface;

a representation of an animal on the first surface;

an opening in the panel, the opening positioned at a location corresponding to the mouth of the animal on the representation;

a bag dispenser connected to the second surface, the dispenser including a rod having a first end, a second end and a roll mounting portion located between the first end and the second ends;

a hinge connecting the first end to the second surface; and a post connected to the panel for securing the panel to the ground.

7. A yard sign for dispensing animal waste bags, comprising:

a panel having the shape of a character and defining an opening therethrough, said opening configured to resemble said character's mouth, said panel having a decorative front surface resembling the character and a back surface;

a bag dispenser attached to said back surface of said panel, said dispenser positioned to dispense bags through said opening and comprising an elongated strap having a first end, a second end, and a roll mounting portion between said end and a snap fastener releasably engaging at least one of said first and second ends to said back surface; and a post attached to said panel for engaging said panel to the ground.

* * * * *

UNITED STATES PATENT AND TRADEMARK OFFICE

CERTIFICATE OF CORRECTION

PATENT NO. : 6,446,903 B1 
DATED : September 10, 2002
INVENTOR(S) : Nicholas F. Bazan It is certified that error appears in the above-identified patent and that said Letters Patent is hereby corrected as shown below:

Column 5,
Line 40, delete “display”
Line 45, delete “a character” and insert -- an animal --
Line 46, after “panel” delete “;” insert -- , the opening representing the animal’s mouth; --

Signed and Sealed this

Twenty-sixth Day of August, 2003

JAMES E. ROGAN
*Director of the United States Patent and Trademark Office*